US005381745A

United States Patent [19]

Nolle

[11] Patent Number: 5,381,745

[45] Date of Patent: Jan. 17, 1995

[54] METHOD OF SEWING A SEAM AND A SEWING UNIT THEREFOR

[75] Inventor: Wolfgang Nolle, Albstadt, Germany

[73] Assignee: Union Special GmbH, Stuttgart, Germany

[21] Appl. No.: 965,889

[22] Filed: Oct. 23, 1992

[30] Foreign Application Priority Data

Oct. 28, 1991 [DE] Germany ..... 4135456

[51] Int. Cl.[6] ..... D05B 1/00

[52] U.S. Cl. ..... 112/262.1; 112/255

[58] Field of Search ..... 112/262.1, 197, 254, 112/255, 121.25, 63, 121.11, 272, 163, 165, 401, 411, 432, 438, 439, 437

[56] References Cited

U.S. PATENT DOCUMENTS

| | | | |
|---|---|---|---|
| 1,920,784 | 8/1933 | De Voe | 112/439 |
| 3,225,725 | 12/1965 | Casselli | 112/438 |
| 3,447,498 | 6/1969 | Eguchi | 112/197 |
| 4,157,722 | 6/1979 | Tojo et al. | 112/255 X |
| 4,186,676 | 2/1980 | Villa et al. | 112/254 |
| 4,215,641 | 8/1980 | Dobrjansky et al. | 112/255 |
| 4,300,465 | 11/1981 | Tsuboi . | |
| 4,338,823 | 7/1982 | Ueyama | 112/262.1 |
| 4,356,782 | 11/1982 | Ueyama et al. | 112/255 X |
| 4,461,229 | 7/1984 | Angele et al. | 112/255 x |
| 4,548,143 | 10/1985 | Martell et al. | 112/262.1 X |
| 4,726,309 | 2/1988 | Popp | 112/235 |
| 4,886,005 | 12/1989 | Burton, Jr. | 112/255 |
| 4,967,679 | 11/1990 | Hara et al. | 112/255 |
| 4,998,491 | 3/1991 | Hanyu et al. | 112/255 X |
| 5,022,335 | 6/1991 | Hayu et al. | 112/262.1 X |

FOREIGN PATENT DOCUMENTS

| | | |
|---|---|---|
| 559157 | 2/1944 | United Kingdom . |
| 1194967 | 6/1970 | United Kingdom . |
| 2228273A | 8/1990 | United Kingdom . |

OTHER PUBLICATIONS

Catalog No. 282, Union Special, Class 34700 KF sewing machine Jan. 1990.

German Standard DIN 61400 (German Institute for Standardization, 1988) Dec. 1988.

International Standard ISO 4915 (2d ed.) Dec. 1990.

*Primary Examiner*—Clifford D. Crowder
*Assistant Examiner*—Larry D. Worrell, Jr.
*Attorney, Agent, or Firm*—Willian Brinks Hofer Gilson & Lione

[57] ABSTRACT

A multi-needle chain-stitch seam is secured against unravelling and loosening by the following steps: A beginning region (A) of the seam is formed with short needle thread loops (6,7) an intermediate region (B) of the seam is formed with long needle thread loops (9) and an end region (C) is again formed with short needle thread loops (6,7).

An adjusting member (67) actuated in a controlled manner on a sewing unit influences the formation of the stitches of the seam.

12 Claims, 6 Drawing Sheets

METHOD OF SEWING A SEAM AND A SEWING UNIT THEREFOR

BACKGROUND OF THE INVENTION

The invention relates to a method of producing a chain-stitched sewing seam in one or more workpiece plies, and to a sewing unit for performing the method.

The International Standard ISO 4915-1981 (E/F) and the German Standard DIN 61400, German Institute for Standardisation e.V, May 1988 Edition, describe multi-needle chain-stitch sewing stitch types of Classes 400 and 600. A sewing stitch type 406 is accordingly formed from three threads: two needle threads and a looper thread. The two needle threads are guided as loops through the workpiece from the needle side and through two separate loops of the looper thread on the other side of the workpiece. A further loop of the looper thread is guided through the loops of the needle threads and is interlinked with the latter, the interlinkages being drawn against the workpiece.

A further sewing stitch type 407 is formed from four threads: three needle threads and a looper thread. The three needle threads are likewise guided as loops through the workpiece from the needle side and through three separate loops of the looper thread on the other side of the workpiece. A further loop of the looper thread is guided through the loops of the three needle threads and are interlinked with the latter, the interlinkages being drawn against the workpiece.

These sewing stitch types may be formed by, for example, the UNION SPECIAL Class 34700 KF sewing machine, Catalogue No. 282, 2nd Edition (UNION SPECIAL is a Trade Mark).

All the multi-needle chain stitch sewing stitch types of the ISO/DIN classes 400 and 600 have, compared with lock-stitch sewing stitch types, the advantage that they may be formed virtually endlessly by sewing cones, although they also have the disadvantage that, if there is no interlinkage, the seam may become undone in the direction opposite to the direction of the seam.

An object of the invention is to provide a method and a device of the generic type which make it possible to secure the seam in one or more workpiece plies against unravelling, particularly at the end of the seam, that is, to secure it against loosening of the looper thread.

SUMMARY OF THE INVENTION

One aspect of the invention is a method of producing a sewing seam by means of a succession of spaced chain-stitch sewing stitches in one or more workpiece plies with the use of at least two needle threads forming loops and at least one looper thread forming loops, which needle threads and looper thread are interlinked, the interlinkages being pulled against the workpiece, in which a beginning region of the seam is formed with short needle thread loops on the underside of the workpiece, an intermediate region of the seam is formed with long needle thread loops on the underside of the workpiece, and an end region is again formed with short needle thread loops on the underside of the workpiece.

Another aspect of the invention resides in a sewing unit for producing a sewing seam, having a chain-stitch sewing machine driven in a controlled manner for producing a seam by means of a succession of chain-stitch sewing stitches disposed at a distance apart in one or more workpiece plies, and having an adjusting member which increases the size of a number of short needle thread loops to large needle thread loops in a controlled manner.

In the formation of the needle thread, the end of the seam is reliably secured against undoing or loosening.

Preferably the stitches in the intermediate region are shorter than those in the beginning and end regions. This facilitates the formation of the long needle thread loops.

The adjusting member, actuated in a controlled manner, makes it possible to form the long needle thread loops.

BRIEF DESCRIPTION OF THE DRAWINGS

The invention will be further described by way of example with reference to the accompanying drawings, in which.

DETAILED DESCRIPTION OF THE PREFERRED EMBODIMENTS

Figure 1:
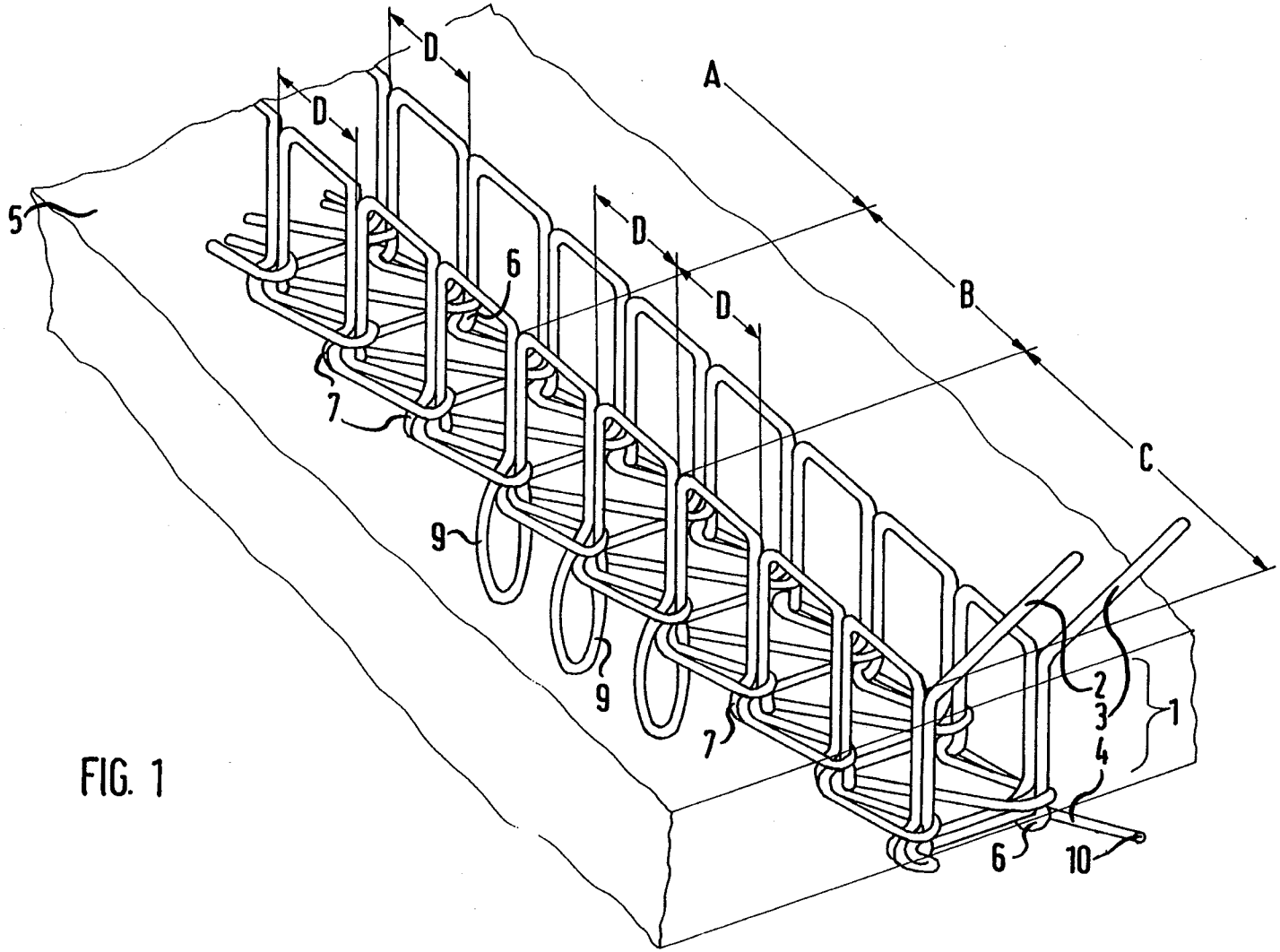
FIG. 1 is a perspective view of a seam, made by the method of the invention, in a workpiece with a constant length of stitch.

FIG. 1 shows, by way of example, a seam 1 which is formed in a workpiece 5, which may comprise one or more plies, by means of a left-hand needle thread 2, a right-hand needle thread 3 and a looper thread 4. The right-hand needle thread 3 has short needle thread loops 6. The left-hand needle thread 2 also has short needle thread loops 7 in a beginning region A, three long needle thread loops 9 in an intermediate region B and which may also be formed in this region in the right-hand needle thread 3, and again short needle thread loops 7 in an end region C of the seam 1. The individual sewing stitches are formed with a constant length at a distance D apart. The seam can be undone only in the end region C by pulling the unlocked, free end 10 of the looper thread 4, this being advantageous when using the workpiece 5.

Figure 2:
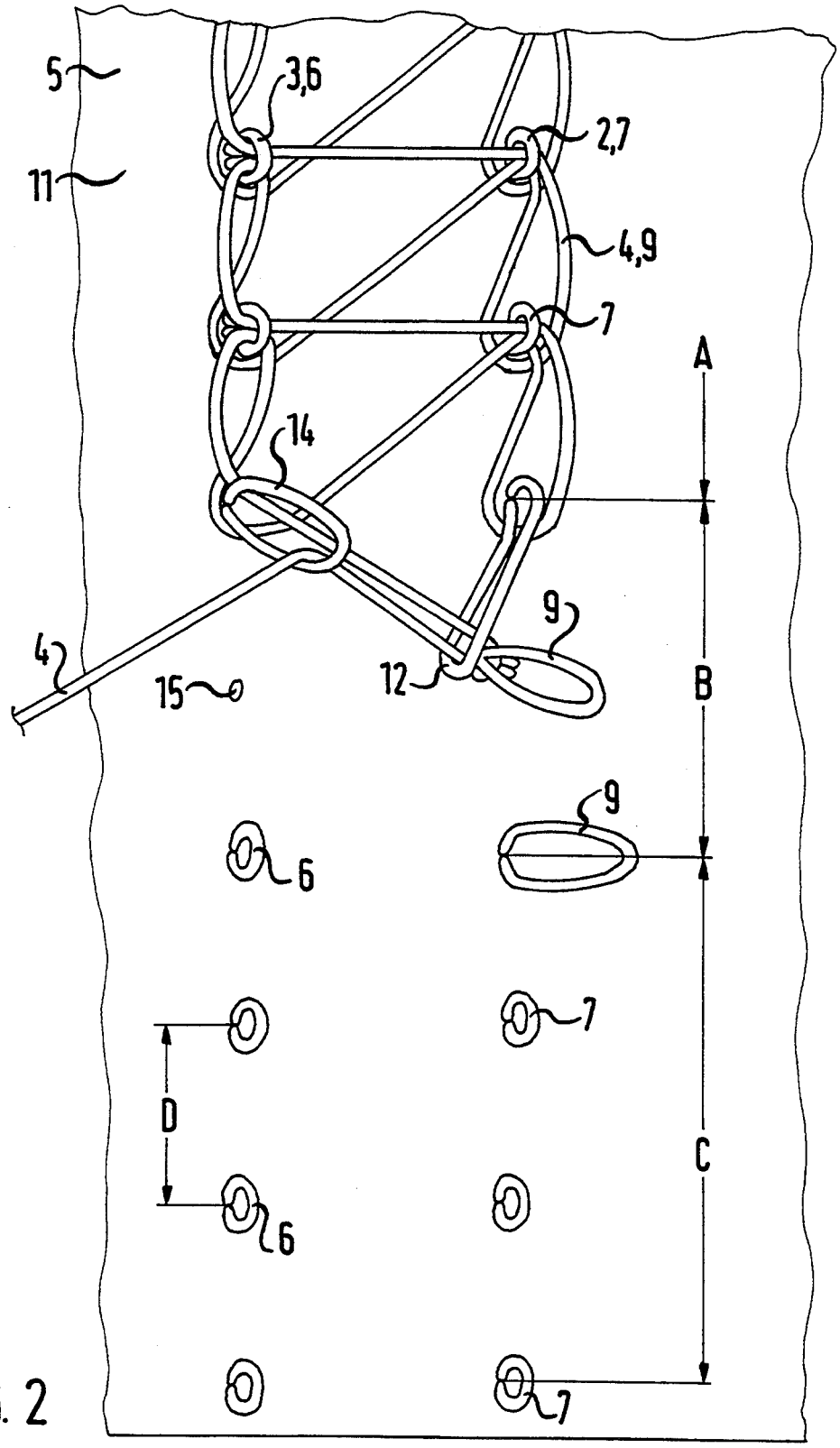
FIG. 2 shows a seam made by the method, visible on the underside of a workpiece, and a partially undone looper thread with a knot being formed.

FIG. 2 shows an underside 11 of the workpiece 5. The seam is now undone in the end region C. A knot 12 being formed is shown in the intermediate region B. One of the original, short needle thread loops 6 is formed as a larger loop 14 whose additional quantity of thread originates from the loosened, short needle thread loop 6 of the needle hole 15.

Figure 3:
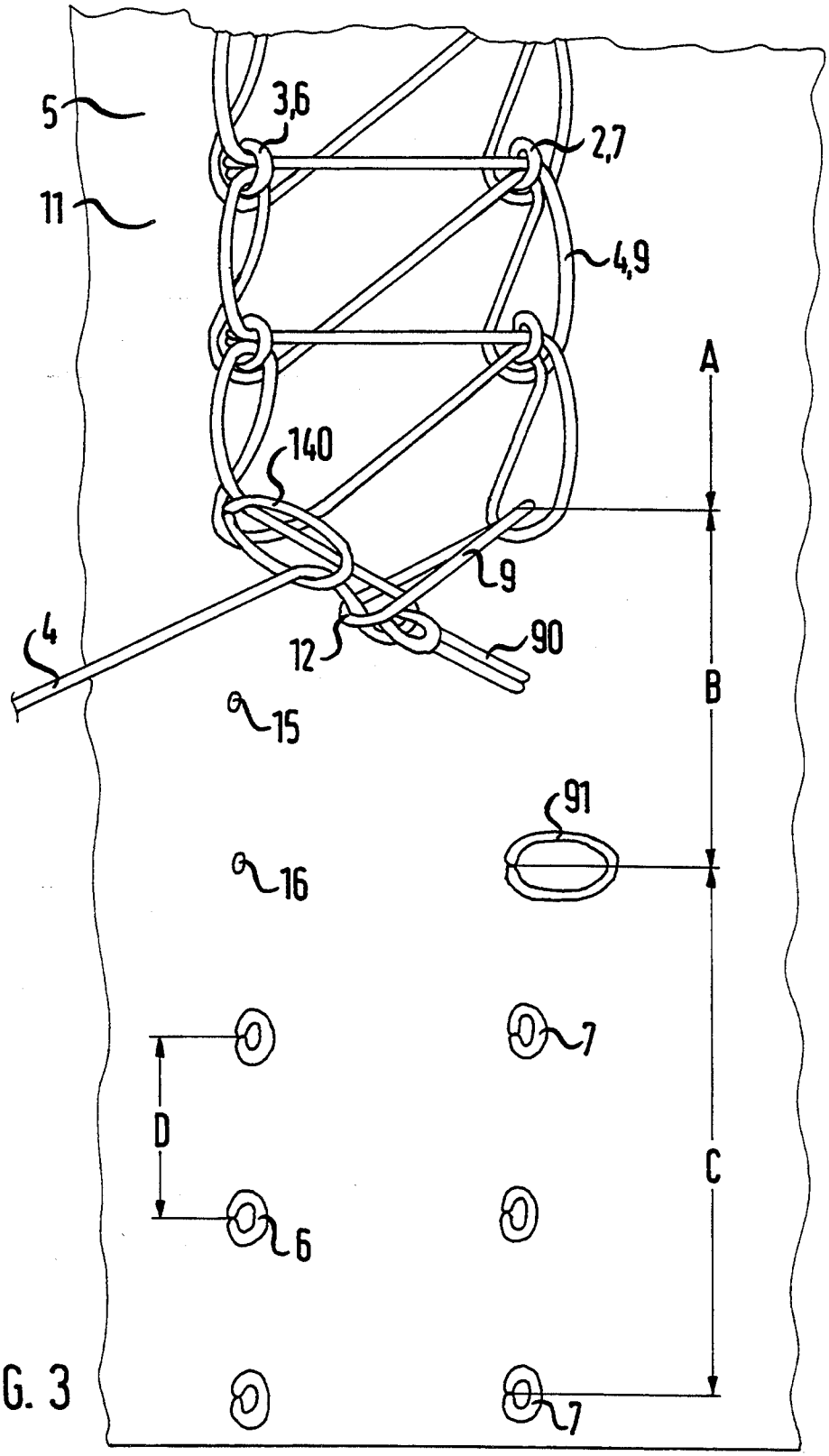
FIG. 3 shows a seam made by the method, visible on the underside of a workpiece, and a looper thread partially undone and knotted with the needle threads.

FIG. 3 also shows the underside 11 of the workpiece 5. The knot 12 has been formed to the extent that the seam 1 is secured against further undoing or loosening. A loop 140 has been further increased in size compared with the loop 14, and its further quantity of thread originates from the loosened loop 6 from the needle hole 16. The quantity of thread of a needle thread loop 90 at the knot 12, likewise increased in size compared with the loop 9, originates from a loop 91 reduced in size compared with the loop 9.

Figure 4:
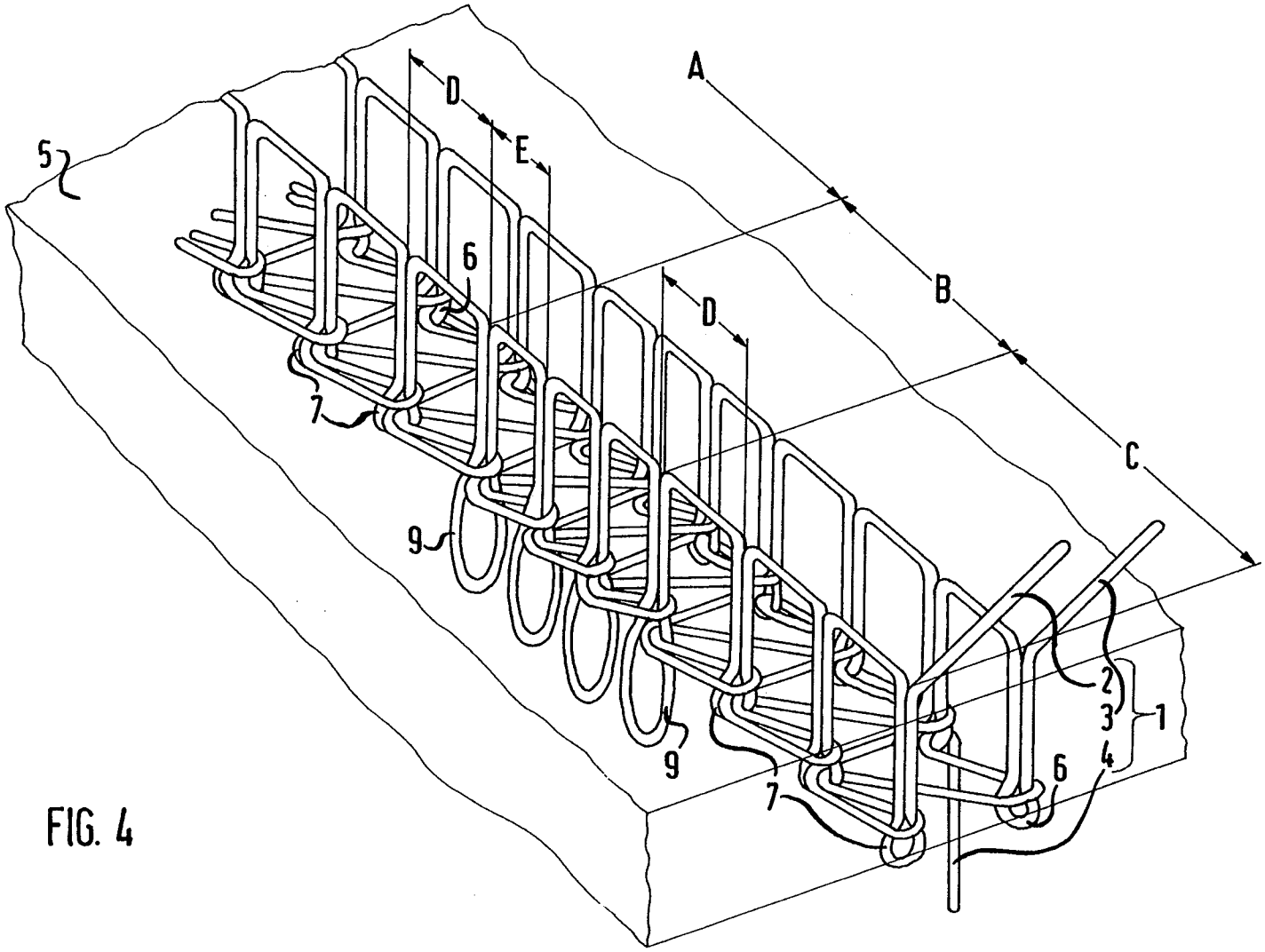
FIG. 4 is a perspective view of another seam made by the method, in a workpiece with the length of stitch partially shortened.

FIG. 4 shows the intermediate region B with a stitch length spaced at a shortened distance E as compared with the stitch length D at the beginning and end regions. The shortening of the original stitch length D to the stitch length E facilitates the enlarged formation of the needle thread loop 9.

Figure 5:
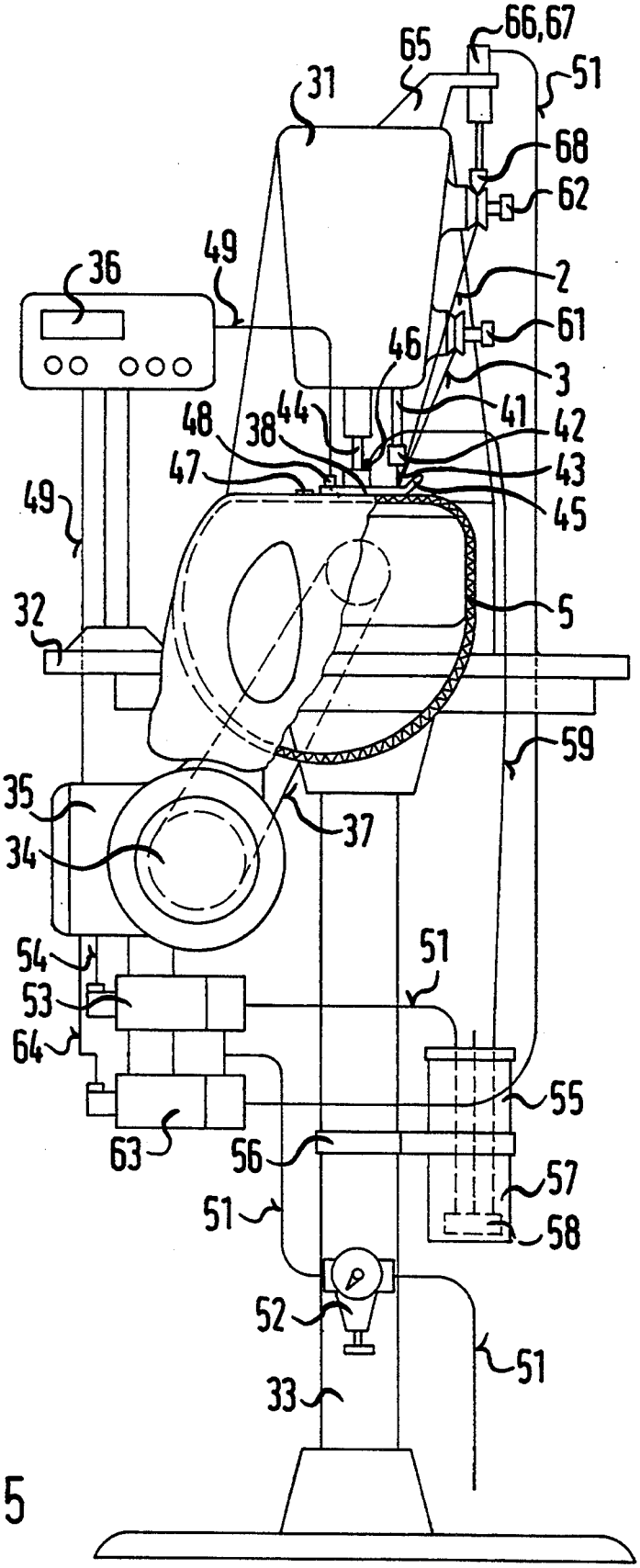
FIG. 5 is a diagrammatic elevational view of a sewing unit for sewing an annular workpiece.

In a sewing unit as shown in FIG. 5, a sewing machine 31 driven in a controlled manner is mounted in a known manner on a table top 32 which is carried by a stand 33. A motor drive 34 having a control box 35 for controlling the working cycle of the sewing machine 31 is flanged to the stand 33. The table top 32 carries an operating panel 36 for inputting seam-specific data, such as the enlarged needle thread loop 9, and for switching on the sewing machine 31 which is driven in a conventional manner by the motor drive 34 by means of a V-belt 37.

The sewing machine 31 has a known workpiece feed device 38 which conveys the annular workpiece 5. A needle bar 41 driven up and down in the sewing machine 31 has a needle head 42 which carries a plurality of sewing machine needles 43. A presser bar 44 likewise movable up and down is disposed adjacent to the needle bar 41 and has a presser foot 45 secured thereto. The presser foot 45 carries a marking means 46 which applies a mark 47 to the workpiece 5. A sensor 48 is connected to the control box 35 by a control line 49 by way of the operating panel 36. A compressed air line 51 leads by way of a pressure reducer 52 to a solenoid valve 53, which is secured to the control box 35 and which is actuated by the control box 35 by way of a line 54, and to a reservoir 55 secured to the stand 33 by a holder 56. The reservoir 55 and the marking means 46 contain a marking agent 57 which may be in the form of water. A pump 58 sprays marking agent 57 onto the workpiece 5 by way of a line 59 in a controlled manner.

A known thread tensioner 61 for the right-hand needle thread 3 and a thread tensioner 62, openable in a controlled manner, for the left-hand needle thread 2 are disposed on the sewing machine 31. The compressed air line 51 leads to a further solenoid valve 63, which is actuated by the control box 35 by way of a control line 64, and towards an adjusting member 67 in the form of a pneumatic cylinder 66 secured to the sewing machine 31 by a holder 65. A wedge-shaped push rod 68 opens the thread tensioner 62 in a controlled manner and thereby reduces the frictional force acting upon the left-hand needle thread 2, which leads to the enlargement of the needle thread loops 7 to loops 9.

Figure 6:
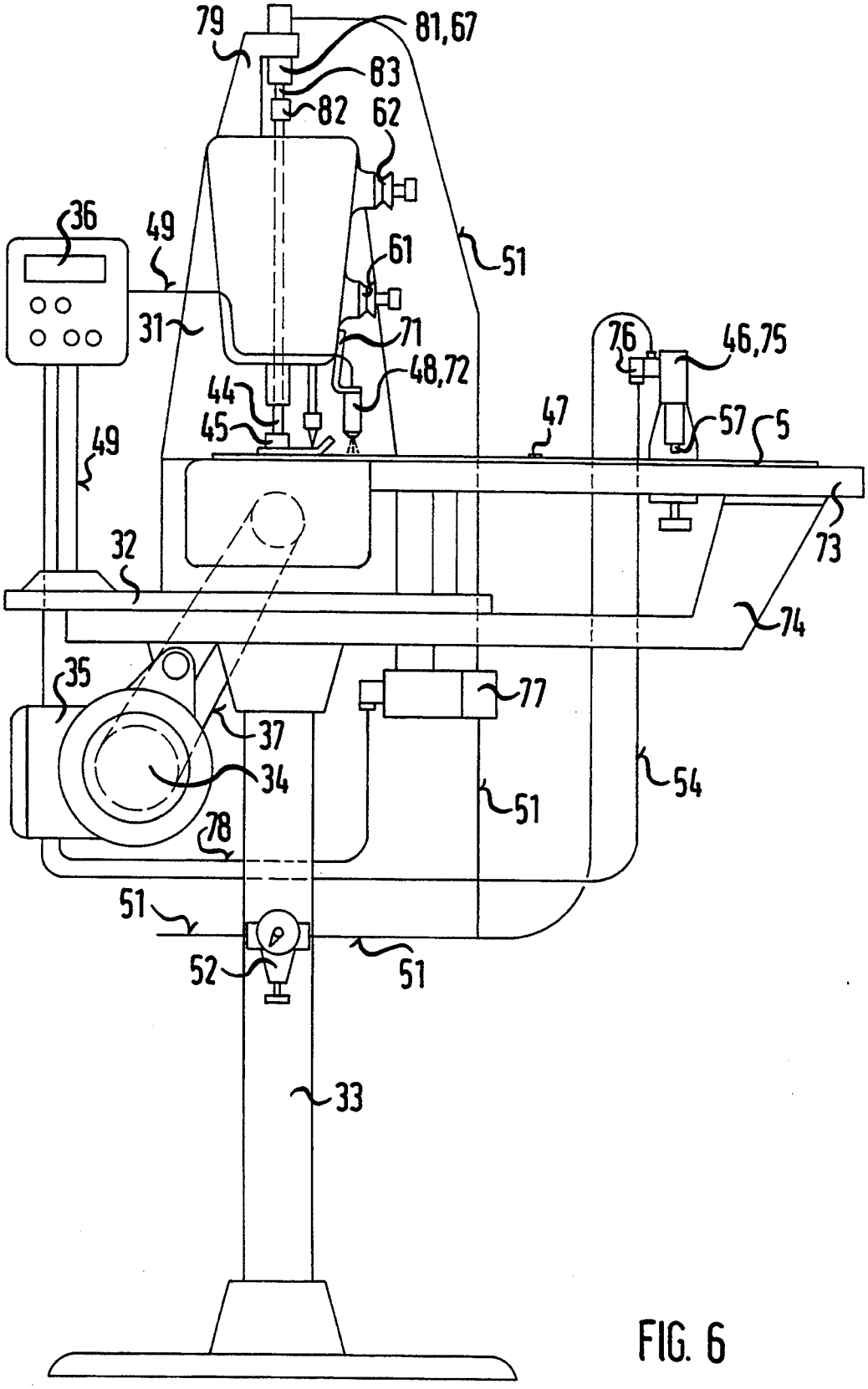
FIG. 6 is a similar view of a sewing unit for sewing a flat workpiece.

FIG. 6 shows the sensor 48 as a luminescence sensor 72 secured to the sewing machine 31 by a holder 71. The marking means 46 is adjustably secured to a plate 73 which is in turn connected to the table top by a holder 74. The marking means 46 is in the form of a marking pin 75 which functions in the following manner: compressed air is conducted by way of the compressed air line 51 through a solenoid valve 76, which is controlled by the control box 35 by way of the line 54, into the marking means 75 which thereby applies marking agent 57 to the flat workpiece 5 and forms the mark 47. The compressed air line 51 leads to a further solenoid valve 77, which is actuated by the control box 35 by way of a control line 78, and to the adjusting member 67 which is secured to the sewing machine 31 by a holder 79 and which is in the form of a further pneumatic cylinder 81. A coupling 82 connects a push rod 83 to the presser bar 44.

The operating cycle of the sewing unit of FIG. 5 runs in the following manner: The presser foot 45 is raised when the annular workpiece 5 is inserted. The solenoid valve 53 is actuated approximately simultaneously upon the lowering of the presser foot 45 and thus marking agent 57 is sprayed onto the workpiece 5 by means of the marking means 46. The mark 47 is evaluated by the sensor 48 during the sewing operation only upon second detection by a control operation in the control box 35. Thus, the annular workpiece 5 is stitched up and the end region of the seam is detected. The adjusting member 67 is actuated by way of the control box 35 approximately seven stitches before the end of the seam, so that a number of long needle thread loops 9, for example four, is formed in order to secure the seam 1 against becoming undone. The remaining sewing stitches are formed in a normal manner as in the beginning region A of the seam 1, so that the sewing threads 2, 3, 4 can be cut off in a reliable and known manner. Alternatively, instead of applying the marking agent 57, the end region of the seam may be detected by detecting a beginning of a seam on the annular workpiece 5 by means of a sensor such as a photoelectric cell.

In the sewing machine of FIG. 6, the operating cycle runs as follows: The flat workpiece 5 is applied to the presser foot 45. Luminophore-containing marking agent 57 is applied to the workpiece 5 by the marking means 46 shortly before, or during, the commencement of the sewing operation and is detected as mark 47 by the luminescence scanner 72 during the sewing operation and is evaluated by a control operation in the control box 36 for the purpose of actuating the adjusting member 67. The seam 1 is then secured by forming a number of long needle thread loops 9, for example three, by actuation of the adjusting member 67, that is, by controlled relief of the presser foot 45. The controlled relief of the presser foot 45 makes it possible to increase the size of the short needle thread loops 6, 7 and at the same time to shorten the stitch length which is shown as a short distance E in FIG. 4. The rest of the sewing stitches are again formed in a normal manner with short needle thread loops 6, 7 and are cut off in a known manner.

The seam-security signal for the controlled actuation of the adjusting member 67 may also be initiated manually, for example by actuation of a known sewing pedal (not shown in the drawings). Before initiating the thread-cutting operation—as described above—the adjusting member 67 is momentarily actuated by backward actuation of the pedal for the purpose of lengthening a number of short needle thread loops 6, 7. The few remaining sewing stitches are then again also formed with shorter needle thread loops 6, 7 in a normal manner and are cut off by a known thread-cutting device to finish the sewing operation.

I claim:

1. A method of producing a sewing seam that is secure against unravelling, the method comprising the steps of:

providing a chain-stitch sewing machine for forming a succession of chain-stitch sewing stitches from at least two needle threads and a looper thread in a workpiece having an upperside and an underside;

forming at least one stitch with the chain-stitch sewing machine in a beginning region of the seam, wherein corresponding needle thread loops are formed on the underside of the workpiece;

forming a plurality of successive stitches with the chain-stitch sewing machine in an intermediate region of the seam, wherein corresponding successive needle thread loops are formed on the underside of the workpiece, the successive needle thread loops in the intermediate region of the seam being longer than the needle thread loops in the beginning region of the seam; and forming at least one stitch with the chain-stitch sewing machine in an end region of the seam, wherein corresponding needle thread loops are formed on the underside of the workpiece, the needle thread loops in the end region of the seam being shorter than the needle thread loops in the intermediate region of the seam.

2. A method as claimed in claim 1, wherein the beginning region of the seam is formed by chain-stitch sewing stitches disposed at a predetermined distance apart, the intermediate region of the seam is formed by successive chain-stitch sewing stitches disposed at a shorter distance apart than the predetermined distance, and the end region of the seam is formed by chain-stitch sewing stitches disposed at the predetermined distance apart.

3. A sewing unit for producing a sewing seam comprising:

a chain-stitch sewing machine for producing a seam by means of a succession of chain-stitch sewing stitches disposed at a predetermined distance apart in a workpiece having at least one ply and an underside, the sewing machine having at least two sewing needles, each needle carrying a needle thread for forming needle thread loops on the underside of the workpiece;

a needle thread tensioner disposed on the sewing machine for tensioning at least one of the at least two needle threads during formation of the seam;

a pneumatic cylinder mounted to the sewing machine by a holder, the pneumatic cylinder biased to contact the needle thread tensioner and to open the needle thread tensioner in a controlled manner by means of a push rod; and a controller connected to the pneumatic cylinder for controlling the tension of at least one of the needle threads during formation of the seam.

4. A sewing unit as claimed in claim 3, wherein the sewing unit further comprises a workpiece feed device attached to the sewing machine for conveying an annular workpiece.

5. A sewing unit for producing a sewing seam having a beginning region, an intermediate region and an end region, comprising:

a chain-stitch sewing machine for producing the seam by means of a succession of chain-stitch sewing stitches disposed at a predetermined distance apart in a workpiece having an upperside and an underside, the sewing machine comprising at least two sewing needles, each needle carrying a needle thread for forming needle thread loops of a predetermined length on the underside of the workpiece, and a presser foot mounted on a presser bar;

a pneumatic cylinder mounted to the sewing machine by a holder, the pneumatic cylinder coupled to the presser bar for drivingly actuating the presser foot in a controlled manner;

a controller connected to the pneumatic cylinder for controlling the position of the presser foot during formation of the seam to adjust the predetermined distance and the predetermined length of the needle thread loops; and means for sensing the end region of the seam, the sensing means being coupled to the controller.

6. A sewing unit as claimed in claim 5, wherein the sewing unit further comprises a workpiece feed device attached to the sewing machine for conveying a flat workpiece.

7. A method as claimed in claim 1, further comprising the steps of:

cutting the needle threads and the looper thread; and pulling the looper thread in the end region of the seam, whereby the needle threads and the looper thread are knotted.

8. A method as claimed in claim 7, wherein the needle thread loops in the intermediate region of the seam being longer than the needle thread loops in the beginning region of the seam are formed from one of the at least two needle threads.

9. A method as claimed in claim 8, wherein the needle threads and the looper thread are knotted on the underside of the workpiece in the intermediate region of the seam.

10. A method as claimed in claim 2, further comprising the step of:

lessening tension on one of the at least two needle threads when forming the plurality of stitches in the intermediate region of the seam.

11. A sewing unit as claimed in claim 3, further comprising:

means for sensing an end region of the seam, the sensing means being coupled to the controller.

12. A sewing unit as claimed in claim 5, wherein the sensing means comprises means for marking the workpiece and means for detecting a marked workpiece.

* * * * *

UNITED STATES PATENT AND TRADEMARK OFFICE

CERTIFICATE OF CORRECTION

PATENT NO. : 5,381,745
DATED : January 17, 1995
INVENTOR(S) : Wolfgang Nolle

It is certified that error appears in the above-indentified patent and that said Letters Patent is hereby corrected as shown below:

On the Title Page item [56], line 8 under "References Cited U.S. PATENT DOCUMENTS" delete "4,338,823" and substitute --4,338,873--.

In the Abstract

Line 5, delete "(9)" and substitute --(8)--.

Signed and Sealed this

Fifth Day of March, 1996

*Attest:*

*Attesting Officer*

BRUCE LEHMAN

*Commissioner of Patents and Trademarks*